US008188608B2

(12) United States Patent
Tell

(10) Patent No.: US 8,188,608 B2
(45) Date of Patent: May 29, 2012

(54) EJECTOR DEVICE

(75) Inventor: Peter Tell, Akersberga (SE)

(73) Assignee: Xerex AB, Taby (SE)

( * ) Notice: Subject to any disclaimer, the term of this patent is extended or adjusted under 35 U.S.C. 154(b) by 393 days.

(21) Appl. No.: 12/522,346

(22) PCT Filed: Jan. 9, 2008

(86) PCT No.: PCT/SE2008/050022

§ 371 (c)(1),
(2), (4) Date: Jul. 7, 2009

(87) PCT Pub. No.: WO2008/085127

PCT Pub. Date: Jul. 17, 2008

(65) Prior Publication Data

US 2009/0295170 A1 Dec. 3, 2009

(30) Foreign Application Priority Data

Jan. 10, 2007 (SE) ..... 0700034

(51) Int. Cl.
*F02B 63/04* (2006.01)
*F02B 13/00* (2006.01)

(52) U.S. Cl. ..... 290/1 R; 290/43; 290/1 A

(58) Field of Classification Search ..... 290/1 A, 290/1 R, 43, 54; 60/325, 398, 698; 417/187
See application file for complete search history.

(56) References Cited

U.S. PATENT DOCUMENTS

| | | | | |
|---|---|---|---|---|
| 3,379,008 | A * | 4/1968 | Manganaro | 180/302 |
| 4,079,591 | A * | 3/1978 | Derby et al. | 60/641.8 |
| 4,149,588 | A * | 4/1979 | Waters | 165/11.1 |
| 4,718,233 | A * | 1/1988 | Barrett | 60/496 |
| 5,157,922 | A * | 10/1992 | Baruch | 60/325 |
| 5,932,940 | A * | 8/1999 | Epstein et al. | 310/40 MM |
| 6,054,838 | A * | 4/2000 | Tsatsis | 320/101 |
| 6,107,692 | A * | 8/2000 | Egri et al. | 290/43 |
| 6,719,536 | B2 * | 4/2004 | Schmalz et al. | 417/187 |
| 7,468,564 | B2 * | 12/2008 | Crisafulli | 290/52 |
| 2002/0155005 | A1 | 10/2002 | Schmalz et al. | |
| 2007/0085342 | A1 * | 4/2007 | Horianopoulos et al. | 290/1 R |
| 2008/0074083 | A1 * | 3/2008 | Yarger et al. | 320/137 |
| 2009/0278360 | A1 * | 11/2009 | Tateoka | 290/1 A |

FOREIGN PATENT DOCUMENTS

| | | | |
|---|---|---|---|
| WO | 2006039959 | | 4/2006 |
| WO | WO 2006/039959 | A1 * | 4/2006 |

OTHER PUBLICATIONS

International Search Report dated Apr. 9, 2008, from corresponding PCT application.

* cited by examiner

*Primary Examiner* — Julio Gonzalez
(74) *Attorney, Agent, or Firm* — Young & Thompson

(57) ABSTRACT

An ejector device effective to generate a negative pressure by element of compressed air fed to an ejector of the device via a compressed-air duct includes an air suction duct, a pressure sensor and an electrically activatable valve member arranged in the compressed-air duct for regulating the flow of compressed air to the ejector, as well as electrically supplied control electronics (6) adapted to actuate the valve member in response to the pressure in the air suction duct detected by the sensor. The device includes an accumulator by which the control electronics are supplied with electricity, and a generator, which via a charging air duct (9), is in flow communication with the compressed-air duct and is driven by compressed air for generating electrical energy, which is brought into the accumulator for charging the same.

11 Claims, 3 Drawing Sheets

EJECTOR DEVICE

TECHNICAL FIELD OF THE INVENTION

The invention relates to an ejector device that is driven by compressed air in order to generate a useful negative pressure. The invention relates in particular to such ejector devices the operation of which is controllable by means of electrically supplied control electronics.

BACKGROUND AND PRIOR ART

Ejector devices of this type comprise one or more ejectors containing one or more jets or nozzles arranged in sequence and through which an air flow is fed at high pressure. The compressed air is fed to the ejector via a compressed-air duct connected to a source of compressed air. The ejector is in flow communication with a space from where air is evacuated by suction into the flow of compressed air through the ejector via slits formed between the nozzles, or at the outlet of the individual jet. The evacuated space is, via an air suction duct, in flow communication with a gripping member, such as a suction cup.

The flow of compressed air to the ejector may be adjustable by means of a valve arranged in the compressed-air duct and adapted to open and shut off the flow of compressed air, and, where appropriate, for partial restriction of the flow to the ejector. The valve may be associated with an electrical control member that regulates the flow of compressed air in accordance with instructions in a working program, and/or in response to a detected negative pressure sensed by means of a pressure sensor that communicates with the air suction duct. In a maximally decentralized embodiment, each suction cup has one or more dedicated ejectors, valve units and control members, and therefore only compressed air and electrical supply need to be led up to the individual suction cup.

From WO 2006/039939 A1, there is known an ejector device of the type generally described above, which is provided with an energy-storing member for temporary electrical supply of a control and/or a valve unit upon power failure. The energy-storing member may be in the form of a capacitor, a battery, an accumulator or a magnetic coil. The energy-storing member guarantees that negative pressure is maintained in the air suction duct during a temporary power failure, but does not avoid the need of electric connection of the ejector and thereby does not result in a simplified installation in comparison with prior art.

SUMMARY OF INVENTION

The object of the present invention is to provide an ejector device having its own electrical supply capacity, whereby necessary installations may be reduced to the connection of compressed air only.

The object is met in an ejector device as defined in claim 1. Embodiments of the invention are defined in more detail in the dependent claims.

In brief, there is accordingly provided an ejector device that is effective to generate a negative pressure by means of compressed air that is fed to an ejector via a compressed-air duct, furthermore comprising an air suction duct, a pressure sensor arranged in the air suction duct as well as an electrically activatable valve member arranged in the compressed-air duct to the ejector and effective for the regulation of the flow of compressed air to the ejector, as well as electrically supplied control electronics that at least is adapted to activate the valve member in response to the pressure in the air suction duct detected by the sensor, furthermore comprising an energy-storing member in the form of an accumulator by which the control electronics is supplied with electricity. The ejector device is characterized by having a generator that is in flow communication with the compressed-air duct and adapted to be driven by compressed air so as to enable charging of the accumulator.

The ejector device is advantageously disposed in a housing that has a compressed-air duct that on the outside of the housing has an accessible connection for an external source of compressed air and an air suction duct that on the outside of the housing has an accessible connection for a suction cup, wherein a charging air duct is formed in the housing, which duct in the first end thereof connects to the compressed-air duct and with the other end thereof opens in the generator.

In one embodiment, the generator comprises a stator and a body linearly movable in relation to the same, the movable body being biased by a spring member and alternatingly actuated by the spring member and by compressed air in order to be brought into a reciprocating motion in relation to the stator.

In another embodiment, the generator comprises a stator and a rotor, which are adapted to be driven in relative rotation by means of an impeller or turbine wheel actuated by compressed air.

In yet another embodiment, the generator comprises a ring-shaped rotor rotatably supported in relation to a stator arranged externally of the same, which rotor, in a through central duct, has vanes, blades or the corresponding formations that by a through flow of compressed air brings the rotor into rotation in relation to the stator.

The charging air duct may have a first end that connects to the compressed-air duct downstream the valve member, whereby the generator is driven in synchronization with the work cycle of the ejector for generating negative pressure.

The accumulator may advantageously consist of a lithium-ion accumulator.

Additional details and advantages of the invention are explained in the following detailed description.

BRIEF DESCRIPTION OF THE DRAWINGS

The invention is explained in more detail below, reference being made to the accompanying schematic drawings wherein.

DETAILED DESCRIPTION OF EMBODIMENTS

To start with, it should be emphasized that with the expression "useful negative pressure" is, in this connection, refers to a pressure lower than the surrounding atmosphere, which is utilized in an industrial process. Furthermore, the expression "generator" refers to a device that is adapted to transform mechanical energy into electrical energy, utilizing electromagnetic induction. The source of the mechanical energy may be a driven rotary motion, such as in the case of a direct-current generator, or a driven reciprocating motion, such as in the case of a solenoid/magnetic coil.

Figure 1:
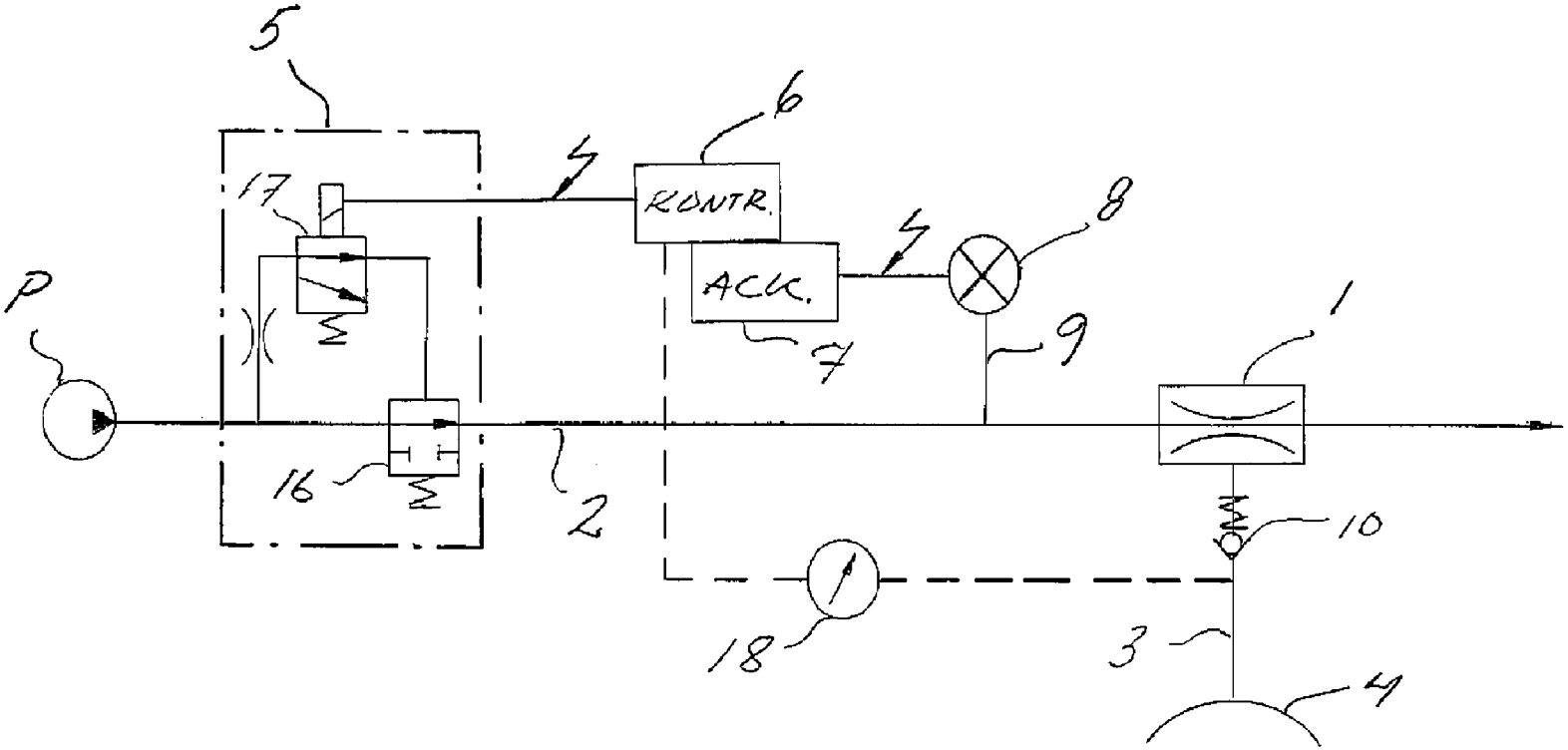
FIG. 1 is an electrical/pneumatical block diagram of an ejector device according to the invention.

With reference to FIG. 1, an ejector device according to the invention is shown in the form of a simplified electrical/ pneumatical block diagram. In the diagram, the reference number 1 refers to an ejector, which via a compressed-air duct 2 is driven by an external source of compressed air P in order to generate a negative pressure. The negative pressure is fed from the ejector via an air suction duct 3 to a gripping member, for instance to a suction cup 4. In the compressed-air duct, an electrically controlled valve member 5 is arranged and controlled for the opening and shutting off, respectively, of the flow of compressed air to the ejector 1. The valve member 5 regulates the work cycle of the ejector by means of an operation control member in the form of electrically supplied control electronics 6. The control electronics 6 is supplied from an energy-storing member 7, and more precisely from a rechargeable accumulator 7. For charging of the accumulator 7, a generator 8 is provided, which, in a way described in more detail below, is adapted to be driven by compressed air via a charging air duct 9 that connects the generator 8 with the compressed-air duct 2. A non-return valve 10 in the suction duct 3 blocks return flow to the suction cup 4 when the ejector is shut off.

Figure 2:
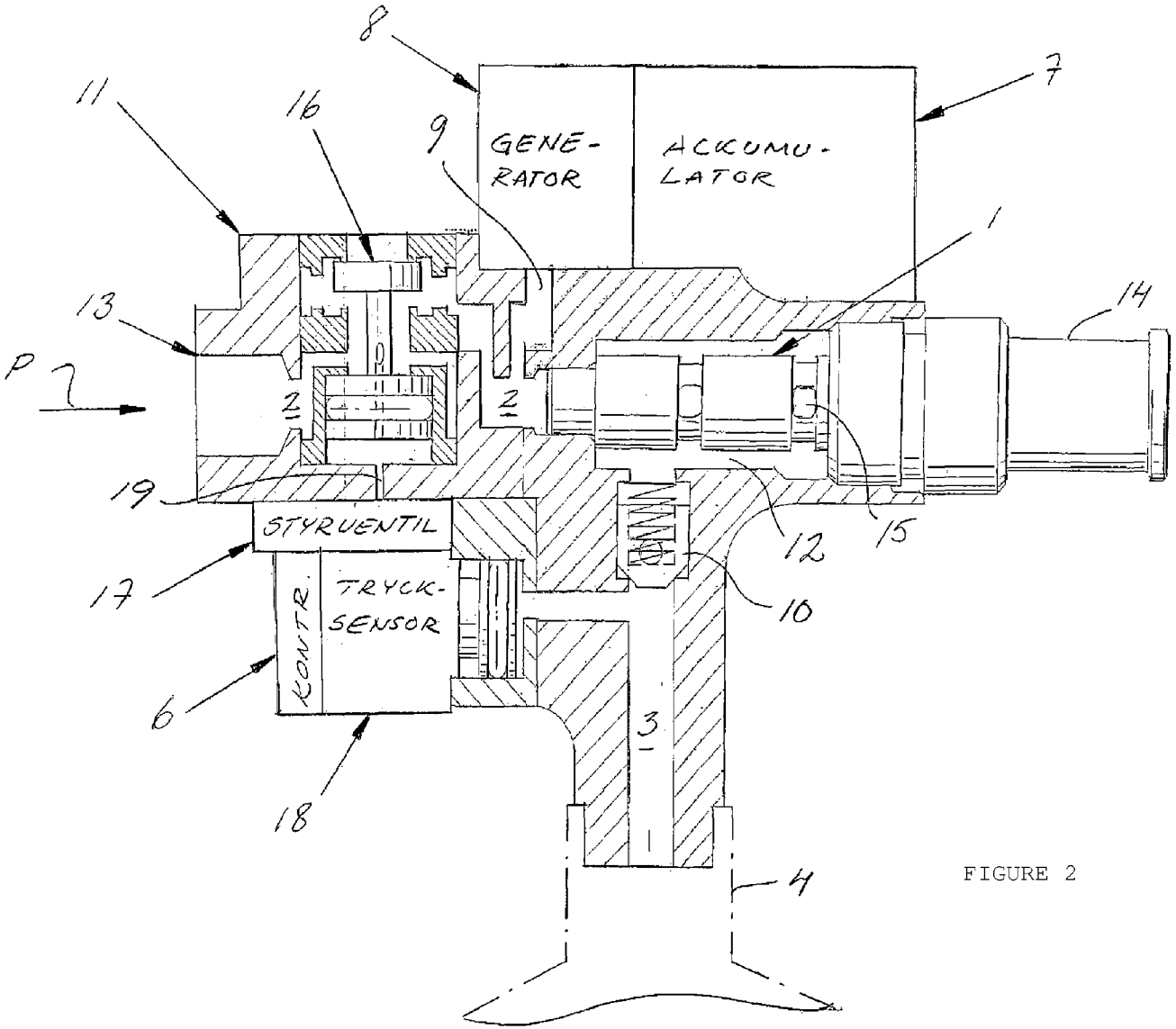
FIG. 2 is a schematic cross-section through an embodiment of an ejector device according to the invention, and FIGS. 3*a*-3*c* schematically illustrate alternative embodiments of an electrical supply unit included in the ejector device.

With reference to FIG. 2, the ejector device is shown realised in an embodiment of the invention. The embodiment in FIG. 2 is characterized by a high degree of integration of functions in an ejector device included in a decentralized vacuum system. In particular, the ejector device is characterized in that it is self-supplying in respect of electrical power for the control functions thereof.

The ejector device in FIG. 2 comprises a housing 11, which is formed to support at least one ejector 1 and one or more gripping members, here in the form of a single suction cup 4 (illustrated with dash-dotted line). The housing 11 in the illustrated embodiment has a seat 12 for an ejector mounted in the housing, but may alternatively be formed to carry an ejector coupled to the outside of the housing. The ejector 1 is fed with compressed air via the compressed-air duct 2, which opens at the outside of the housing with a connection 13 by which the ejector may be placed in flow communication with the external source of compressed air. The compressed air is fed out of the housing via the outlet of the ejector, if applicable through a sound absorber 14. The ejector 1 may be of a single-stage type or multi-stage type, comprising a single or a plurality of nozzles or jets arranged in sequence. The ejector 1 may advantageously consist of the illustrated multi-stage ejector having a rotationally symmetrical body, and with one or more openings 15 arranged in the shell thereof for evacuation of air from the seat 12. From the seat 12, the air suction duct 3 extends to the suction cup 4 to supply the same with negative pressure. A symbolically shown non-return valve 10 is arranged in the suction duct 3 and blocks return flow to the suction cup when the ejector is shut off.

The housing 11 may be formed integrally or composed of a number of housing parts, and usually comprises means (not shown) for coupling of the housing to a movable carrying member, such as a robot arm or another movable machine part.

The flow of compressed air to the ejector 1 is regulated via a valve member which in the direction of flow P is arranged in the compressed-air duct upstream of the ejector. The valve member in the illustrated embodiment comprises a normally closed main valve 16, which in the drawing figure is shown in the open position thereof for feeding of compressed air to the ejector. The main valve 16 opens for flow in the compressed-air duct 2 upon closure of a leakage flow via an electrically activatable pilot valve 17. The pilot valve 17 may be of electromagnetic type and may advantageously consist of a piezo valve, known in the art, comprising a piezo-electric element. The electrically controlled valve 17 is activated electrically via the control electronics 6, which is associated with a pressure sensor 18 arranged for the detection of pressure in the air suction duct 3. Upon achieved negative pressure, the control electronics 6 is initiated to apply to the electrically controlled valve 17 the electrical voltage (which may correspond to the non-voltage state) that results in the opening of leakage flow from the main valve 16, via the leakage flow duct 19.

In addition to details shown here, the housing 11 may, where appropriate and in a known way, comprise additional ducts and valves for the supply of atmospheric pressure or compressed air to the suction duct 3 and the suction cup 4, respectively, upon active release of the ejector device from a gripped object.

The control electronics 6 is supplied with electricity from the accumulator 7 arranged in, at or on the housing 11 and that for the charging thereof is associated with a generator 8. The generator 8 is driven by compressed air for the generation of electrical energy, for which purpose compressed air is fed to the generator 8 via the charging air duct 9 arranged in the housing. The charging air duct 9 places the generator in flow communication with the compressed-air duct 2 and opens for this purpose in the compressed-air duct, preferably between the main valve 16 and the ejector 1 for driving the generator in synchronization with the work cycle of the ejector device.

The generator 8, only symbolically illustrated in FIG. 2, may be realised in different embodiments wherein the drive pressure of the ejector is utilized to generate electrical energy. By, in the way taught via a charging air duct 9, utilizing the compressed air that is fed to the ejector device, a relative motion, such as a rotation or a linear relative motion, may be provided between a permanent-magnet body and a wire winding for induction of electrical energy in the winding.

Figure 3A:
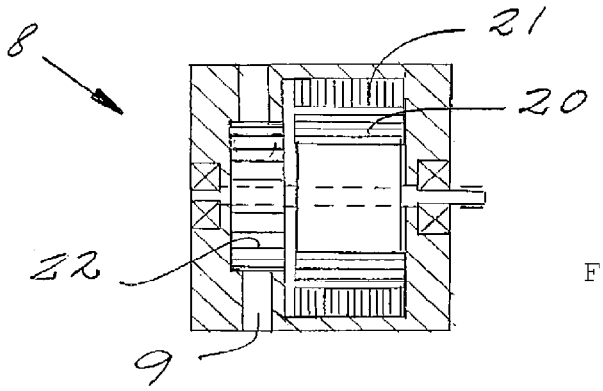

With reference to FIG. 3*a*, the generator 8 may in one embodiment comprise a rotatably mounted rotor 20, which is driven to rotate in relation to a stator 21 arranged rotationally fixed. The rotor 20 suitably comprises a winding in which electrical energy is induced under rotation in a magnetic field provided by permanent magnets in the stator 21, or vice versa. The generated energy may in a known way be collected to be stored in the accumulator 7, for instance via sliding contacts arranged at the rotor or on the rotor shaft. In this embodiment, the rotor 20 is connected to a turbine wheel 22, to which compressed air is fed out tangentially from the mouth of the charging air duct 9.

Figure 3B:
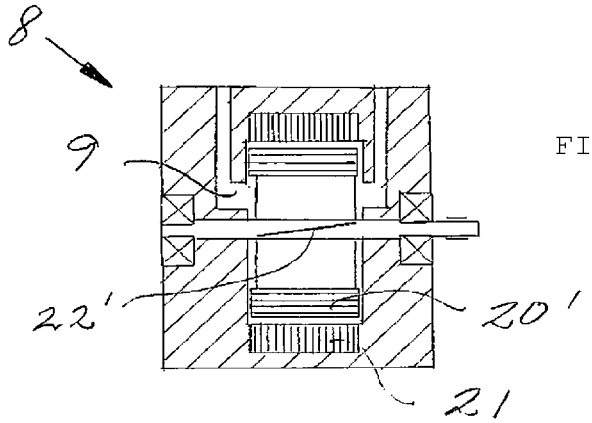

In FIG. 3*b*, an alternative embodiment is shown wherein a ring-shaped rotor 20' has been given the shape of a cylinder having a central through duct in which vanes, blades or the corresponding formations 22' are arranged and forming a turbine to which compressed air is fed out axially from the mouth of the charging air duct 9 in order to bring the rotor into rotation in relation to a stator 21.

Figure 3C:
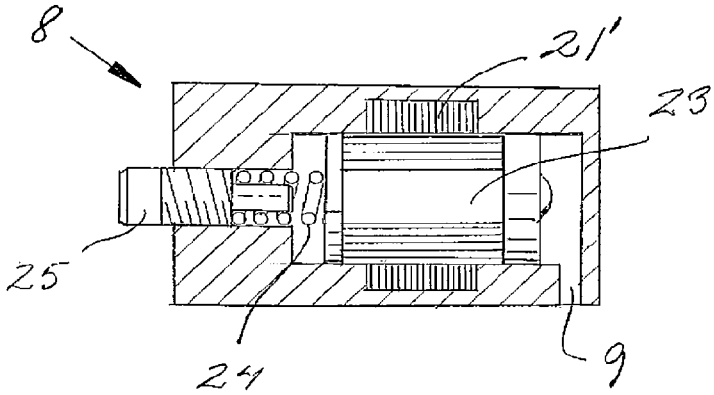

FIG. 3*c* shows an additional alternative embodiment wherein a body 23 is mounted for linear reciprocating motion in relation to a stator 21' arranged externally of the body. Either of the body 23 and the stator 21' comprises a wire winding, while the other comprises permanent magnets. The relative motion is generated by compressed air in co-operation with a spring member 24. Pressure is applied to the body 23 via the charging air duct 9 when feeding compressed air for driving the ejector, with the result that the body 23 is displaced against the force of the spring member 24. When the drive pressure to the ejector is shut off, the pressure against the body 23 falls to atmospheric pressure, the body 23 then being returned to the original position thereof by the action of the spring member 24. The force of the spring member may suitably be adjustable by means of an adjusting screw 25. The frequency of the motion of the body depends on the length of time of the work cycles, and may at most typically amount to the order of 1-10 strokes per second depending on the application.

It will be appreciated that the generator 8 integrated in the ejector device should be adapted to supply a direct-current voltage to the accumulator 7. The latter may advantageously consist of, for example, a lithium-ion accumulator, which may be compensating charged continuously without the need of preceding complete discharge. Nevertheless, for the utilization of the invention, other types of rechargeable accumulators may be possible. Necessary electrical/electronic components for the generation, rectification, stabilization and filtering of the charging current are available in the commerce for assembling by a person skilled in the art.

The demand for power varies with the application, the total demand for power for the electronic control 6 depending on the number of built-in functions in addition to driving of the electrically controlled valve 17. In the case of a piezoelectric valve 17, the demand for power may be estimated to the order of 1-10 mA at a voltage of 5-30 V, which corresponds to a marginal part of the mechanical energy available in the compressed air that drives the ejector device. If a generator 8 of the embodiments according to FIGS. 3*a*, 3*b* is dimensioned in size in comparison with a bicycle dynamo, it is, for example, possible to generate a current of the order of 0,5 A, which provides a power of 3-6 W at a voltage of 6 or 12 V. The accumulator 7 is dimensioned in correspondence with the demand for power in question by assembling the necessary number of accumulator cells.

Additional functions of the electronic control 6 may, for instance, comprise a memory unit for storage of commands that, via a processor, control the driving of the electrically controlled valve, where appropriate under the influence of the pressure detected in the suction duct 3. Furthermore, a wireless interface may be included in the electronic control 6 for transfer of signals to and from the ejector device 1, for instance via mobile telephony networks, local wireless telephony networks, or via so-called Bluetooth communication. Communication ports for plug-in of miniaturized hard drives or so-called USB memories may be arranged for storage of movable operation data and/or for setting of new operation parameters, or for programming of the electronic control by means of a connectable external computer.

An ejector device disposed in the way taught allows a simplified installation, because only compressed air for driving the ejector and the power generation function needs to be connected, which reduces the number of supply lines to the device, in particular as the control electronics also may comprise members for wireless transmission of operation signals and operation data. It will be appreciated that the invention may be realised in a plurality of embodiments having in common that the compressed air that is fed to the ejector in order to generate a negative pressure also is utilized for the generation of charging current to an accumulator, whereby the ejector device becomes self-supplying in respect of electrical energy.

LIST OF DESIGNATIONS

1 Ejector
2 Compressed-air duct
3 Air suction duct
4 Gripping member (e.g., suction cup)
5 Valve member
6 Electronic control
7 Accumulator
8 Generator/solenoid
9 Charging air duct
10 Non-return valve
11 Housing
12 Seat
13 Compressed-air connection
14 Sound absorber
15 Opening
16 Main valve
17 Pilot valve
18 Pressure sensor
19 Leakage flow duct
20 Rotor
20' Rotor
21 Stator
21' Stator
22 Turbine wheel
22' Turbine
23 Body
24 Spring
25 Adjusting screw

The invention claimed is:

1. Ejector device effective to generate a negative pressure by means of compressed air that is fed to an ejector (1) included in the device via a compressed-air duct (2), furthermore comprising an air suction duct (3), a pressure sensor (18) arranged in the air suction duct as well as an electrically activatable valve member (5) arranged in the compressed-air duct and effective for the regulation of the flow of compressed air to the ejector, as well as electrically supplied control electronics (6) which at least is adapted to actuate the valve member in response to the pressure in the air suction duct detected by the sensor, furthermore comprising an energy-storing member (7) in the form of an accumulator by which the control electronics is supplied with electricity, characterized in that, in addition to the compressed-air duct (2) and the air suction duct (3), the device also comprises a charging air duct (9), which in a first end connects to the compressed-air duct and with another end opens at a generator (8) that, via the charging air duct (9), is in flow communication with the compressed-air duct (2) and is driven by compressed air for the generation of electrical energy, which is brought into the accumulator (7) for charging the same, and in that the first end of the charging air duct (9) connects to the compressed-air duct (2) downstream of the valve member (5), and in that the generator is driven in synchronization with a work cycle of the ejector for generating negative pressure.

2. Ejector device according to claim 1, characterized in that the generator comprises a stator (21') and a linearly movable body (23), the movable body being biased by a spring member (24) and alternatingly actuated by the spring member and by compressed air in order to be brought into a reciprocating motion in relation to the stator.

3. Ejector device according to claim 1, characterized in that the generator (8) comprises a stator (21) and a rotor (20;20'), which are adapted to be driven in relative rotation by means of an impeller or turbine wheel (22;22') actuated by compressed air.

4. Ejector device according to claim 3, characterized by a ring-shaped rotor (20') rotatably supported in relation to a stator (21) and arranged externally of the stator, which rotor, in a through central duct, has vanes, blades or the corresponding formations (22') that by a through flow of compressed air brings the rotor into rotation in relation to the stator.

5. Ejector device according to claim 1, characterized in that the accumulator (7) consists of a lithium-ion accumulator.

6. Ejector device according to claim 1 comprising a housing (10) supporting the ejector, which housing has a compressed-air duct (2) that on the outside of the housing has an accessible connection for an external source of compressed air and an air suction duct (3) that on the outside of the housing has an accessible connection for a gripping member, characterized by a charging air duct (9) formed in the housing and that connects the compressed-air duct (2) with a generator (8) supported by the housing.

7. Ejector device according to claim 2, characterized in that the generator (8) comprises a stator (21) and a rotor (20;20'), which are adapted to be driven in relative rotation by means of an impeller or turbine wheel (22;22') actuated by compressed air.

8. Ejector device according to claim 7, characterized by a ring-shaped rotor (20') rotatably supported in relation to a stator (21) and arranged externally of the stator, which rotor, in a through central duct, has vanes, blades or the corresponding formations (22') that by a through flow of compressed air brings the rotor into rotation in relation to the stator.

9. Ejector device according to claim 2, characterized in that the first end of the charging air duct (9) connects to the compressed-air duct (2) downstream the valve member (5), and in that the generator is driven in synchronization with work cycle of the ejector for generating negative pressure.

10. Ejector device according to claim 2, characterized in that the accumulator (7) consists of a lithium-ion accumulator.

11. Ejector device according to claim 2 comprising a housing (10) supporting the ejector, which housing has a compressed-air duct (2) that on the outside of the housing has an accessible connection for an external source of compressed air and an air suction duct (3) that on the outside of the housing has an accessible connection for a gripping member, characterized by a charging air duct (9) formed in the housing and that connects the compressed-air duct (2) with a generator (8) supported by the housing.

* * * * *